US007509708B1

(12) United States Patent
Radke et al.

(10) Patent No.: US 7,509,708 B1
(45) Date of Patent: Mar. 31, 2009

(54) CONCEALED HINGE

(75) Inventors: Todd F. Radke, Chico, CA (US); Ronald M. Hartt, Chico, CA (US)

(73) Assignee: ATC Hardware Systems Inc., Chico, CA (US)

( * ) Notice: Subject to any disclaimer, the term of this patent is extended or adjusted under 35 U.S.C. 154(b) by 0 days.

(21) Appl. No.: 11/849,235

(22) Filed: Aug. 31, 2007

(51) Int. Cl.
*E05D 7/10* (2006.01)

(52) U.S. Cl. ..... 16/258; 16/237; 16/238; 16/245

(58) Field of Classification Search ..... 16/258, 16/382, 235–238, 242, 245
See application file for complete search history.

(56) References Cited

U.S. PATENT DOCUMENTS 4,227,284 A * 10/1980 Zernig ..... 16/238
4,817,241 A * 4/1989 Koch et al. ..... 16/238
5,412,840 A * 5/1995 Lautenschlager et al. ..... 16/238
5,920,958 A * 7/1999 Domenig et al. ..... 16/237
6,647,591 B1 * 11/2003 Domenig et al. ..... 16/242
6,694,567 B1 * 2/2004 Domenig et al. ..... 16/238
2004/0068840 A1 * 4/2004 Thomas et al. ..... 16/245
2007/0136988 A1 * 6/2007 Bullock ..... 16/245
2007/0209156 A1 * 9/2007 Lautenschlager ..... 16/238
2007/0289094 A1 * 12/2007 Lowe et al. ..... 16/238
2008/0016648 A1 * 1/2008 Lautenschlager ..... 16/238

* cited by examiner

*Primary Examiner*—William L. Miller
(74) *Attorney, Agent, or Firm*—William Bodnar

(57) ABSTRACT

A hinge for detachably anchoring a door to a frame of a piece of furniture includes a mounting and adjustment assembly mounted on the frame, a hinge cup attached to an arm and upper plate, and a locking mechanism attached to the upper plate. An embodiment of the mounting and adjustment assembly includes a base/mounting plate, an adjustment plate and a connecting plate. An embodiment of the locking mechanism is spring actuated to facilitate installation and removal of the door.

19 Claims, 4 Drawing Sheets

CONCEALED HINGE

CROSS REFERENCE TO RELATED APPLICATIONS

None.

FIELD OF THE INVENTION

This present invention relates to hinges for use in furniture, preferably cabinetry.

BACKGROUND OF THE INVENTION

Embodiments of the invention disclosed herein include a hinge mounted at one end to a frame of an article of furniture and at another end to a door. An integrated hinge locking mechanism allows ease of installation and removal of a door at the place of manufacture or on the job site.

In furniture construction two types of cabinet construction are common, face-frame and frameless. Frameless cabinets have a case upon which the door hinges are mounted directly. In face-frame construction a frame, wider than the edge of the case, is attached to the front of the cabinet case.

Face-frame construction allows for a sturdier mounting surface for the door hinges and better support for the door. A face-frame construction will also allow the case to better resist warping and remain square during transportation and installation.

Cabinet construction presents some unique design considerations. Alignment of the doors is paramount to maximize visual and functional effects. In frameless cabinets, a door in a closed position will reveal little of the cabinet case. In face-frame construction a frame, wider than the case, is attached to the front of the cabinet case. The amount of the frame that a door will cover in face-frame construction is called the overlay. Face-frame construction allows the frame, rather than the case, to show because the door does not cover the whole frame surface. Misalignments may be more visible on face-frame construction. Thus it is important that the doors are adjusted properly especially in large overlay, high end cabinets.

Existing face-frame hinges offer different degrees of adjustability to accommodate alignment. However correct alignment and adjustment sometimes necessitates removal of the door from the cabinet frame. It is also desirable at times to align and adjust the doors offsite and remove them for transport to the job site. There are also a variety of reasons for removing and reinstalling the doors before or after alignment. Removal of the doors for cabinet finishing onsite is necessary in many applications. Therefore a face-frame hinge must offer several options for adjustment, be as compact and lightweight as possible to maximize effectiveness, and also allow quick and efficient removal and installation of the doors.

SUMMARY OF THE INVENTION

An object of the invention is to provide a face-frame hinge that makes it easier to mount a door to a frame, adjust the hinge arm and therefore the door with respect to the frame, and remove a door from the frame.

In all embodiments of the invention a mounting and adjustment assembly is utilized to mount the hinge and door to the face-frame of an article of furniture. The mounting and adjustment assembly allows adjustment of a door along the horizontal and vertical axes. An upper plate is used to connect the door to the mounting and adjustment assembly. An adjustment mechanism on the upper plate allows adjustment along a third axis approximately orthogonal to the first two axes.

A locking mechanism on the upper plate provides a method for quick and efficient installation and removal of the door. The locking mechanism shown and described herein is an integrated, spring-actuated pivot lever although other locking mechanisms are contemplated.

Modern cabinetry and storage furniture is most functional when there is easy access to the interior storage area. The challenge to hinge manufacturers is to design a compact hinge that maximizes the effective opening to allow the greatest access to the interior storage portion of the cabinet. The mounting and adjustment assemblies disclosed herein are compact by design to allow maximum access to the cabinet interior. The locking mechanisms described are also designed to minimize the projection of the hinge into the cabinet or furniture opening.

Embodiments of the invention are more closely described on the basis of drawing representations contained herein. Further characteristics, advantages and uses of embodiments of the invention result from the drawings and the descriptions that follow.

DETAILED DESCRIPTION OF THE PREFERRED EMBODIMENTS

Figure 1:
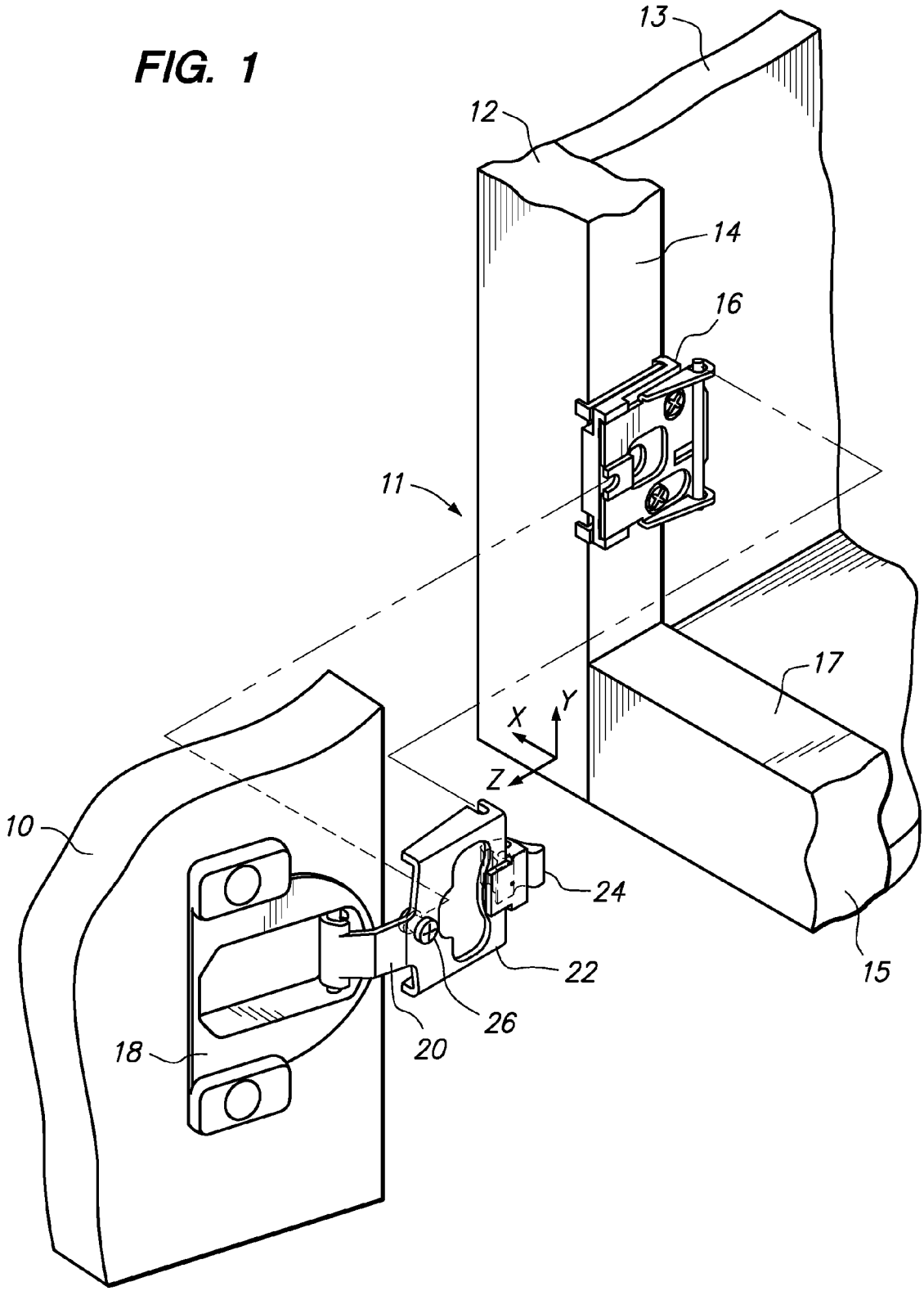
FIG. 1 is a perspective view of the hinge components attached to a cabinet door and cabinet frame.

FIG. 1 shows components of a preferred embodiment of the invention attached to a cabinet door 10 and cabinet frame 11. The frame is connected to the front of the cabinet case 13. The mounting and adjustment assembly 16 is connected to the inner side wall 14 of a vertical component of the face-frame 12. The hinge cup 18, arm member 20, and upper plate 22 are connected to the cabinet door. The pivot lever 24 on the upper plate is used to lock the upper plate in place after it is attached to the mounting and adjustment assembly. The pivot lever is typically spring actuated (spring not illustrated). A shoulder screw 26 is used to allow further movement of the hinge and door with respect to the mounting and adjustment assembly.

The frame 11 is comprised of two vertical components 12 and two horizontal components 15 that form a rectangular structure. The opening or access into the interior is defined by four frame inner walls (only inner walls 14 and 17 are shown). As can be seen, face-frame construction reduces the access to the interior therefore hinge components must be compact so they do not further reduce access.

Figure 2:
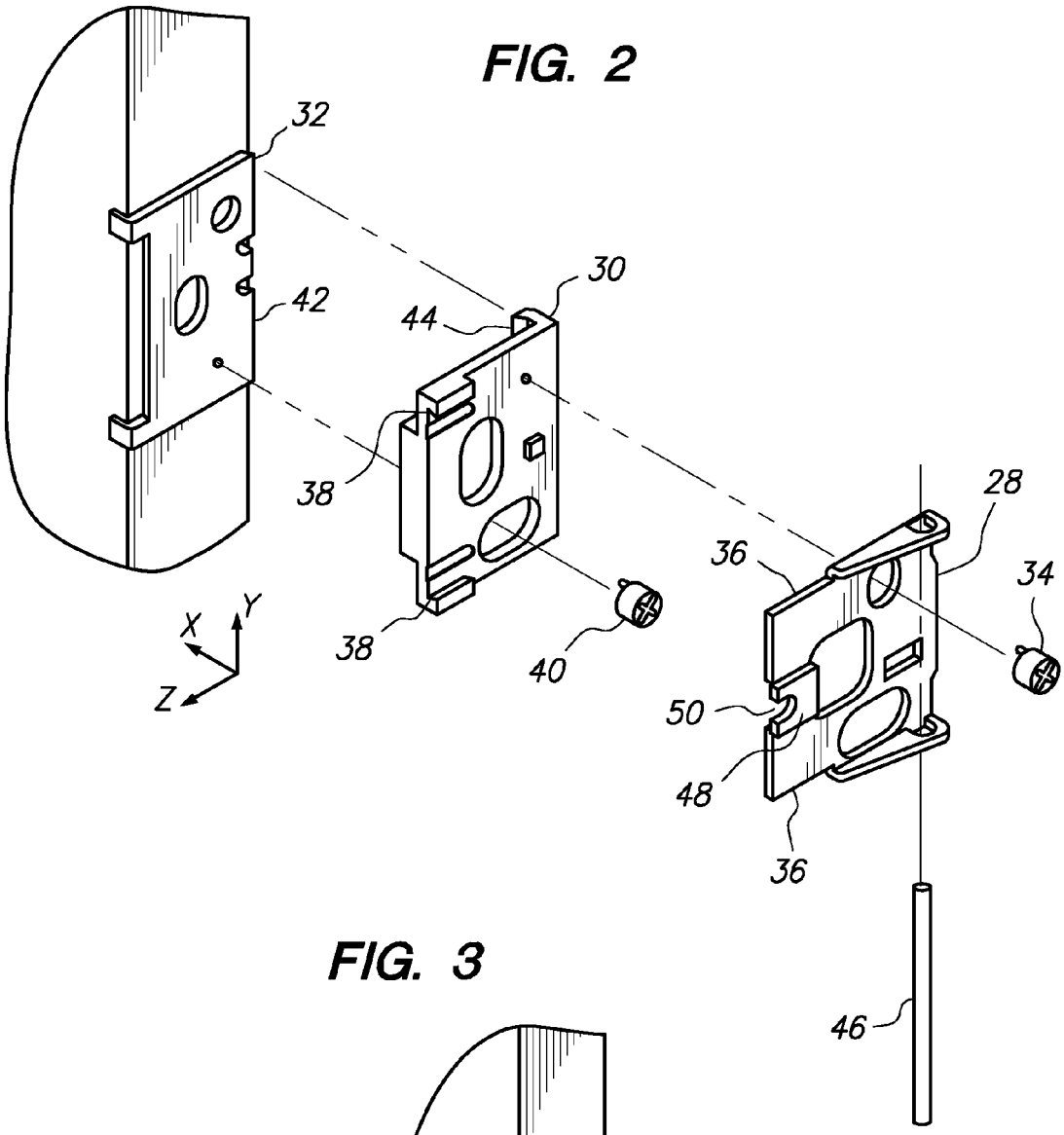
FIG. 2 is an exploded view of the components of the mounting and adjustment assembly.

FIG. 2 shows the individual components of the mounting and adjustment assembly. The connecting plate 28 is moveably attached to the adjustment plate 30. The adjustment plate is moveably attached to the mounting or base plate 32. The connecting plate, adjustment plate, and the mounting plate are attached before the mounting and adjustment assembly is secured to the cabinet face-frame.

The first adjustment mechanism 34 allows the connecting plate 28 to move in two directions along the z-axis (see coordinate orientation) in relation to the adjustment and mounting plates and cabinet frame. The first adjustment mechanism illustrated in FIG. 2 is sometimes referred to as a cam device or eccentric. In the FIG. 2 embodiment, portions of the sides 36 of the connecting plate dovetail into mating sections 38 of the adjustment plate. These dovetailed, beveled surfaces allow more precise movement of a plate with respect to an adjacent plate.

The second adjustment mechanism 40 allows both the connecting plate and adjustment plate to move in two directions along the y-axis in relation to the mounting plate and cabinet frame. Thus, the mounting and adjustment assembly allows four directions of movement. Mating dovetailed sections on the base plate 42 and the adjustment plate 44 allow the movement controlled by the second adjustment mechanism (cam, screw or eccentric).

The connecting plate pin 46 is utilized by the upper plate for connection purposes. The bridge 48 and bridge slot 50 are utilized in conjunction with the shoulder screw to aid in connecting the upper plate to the mounting and adjustment assembly.

Figure 3:
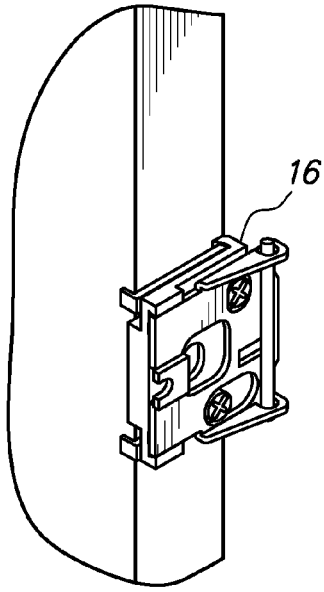
FIG. 3 is a perspective view of the mounting and adjustment assembled attached to the face-frame of a cabinet.

The complete mounting and adjustment assembly 16 is shown attached to an inner side wall of the cabinet face-frame in FIG. 3. The pin 46 is shown affixed to the connecting plate. The pin is typically connected to the upper plate by swaging. Swaging is a metal-forming technique in which the metal or a portion of a metal component is plastically deformed to its final shape using high pressures, either by pressing or hammering, or by forcing through a die. The ends of the pin here can be swaged to hold the pin in place within the connecting plate.

FIGS. 4A through 4D presents top views illustrating the sequence of attaching the upper plate and arm to the mounting and adjustment assembly. These components are shown unattached to the cabinet door and frame for clarity.

Figure 4A:
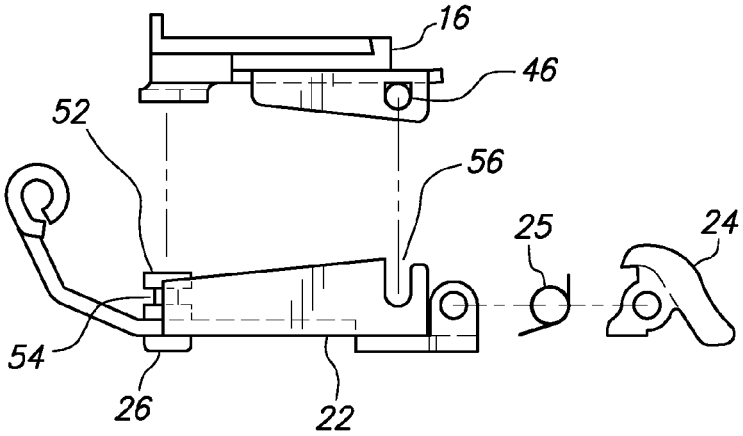
FIGS. 4A through 4D illustrates the steps of attaching the upper plate and hinge arm to the mounting and adjustment assembly.

FIG. 4A shows the relative alignment orientations for the connecting components of the upper plate and the mounting and adjustment assembly. The shoulder 52 and recess 54 of shoulder screw 26 are utilized to help affix the upper plate 22 to the mounting and adjustment assembly 16.

Figure 4B:
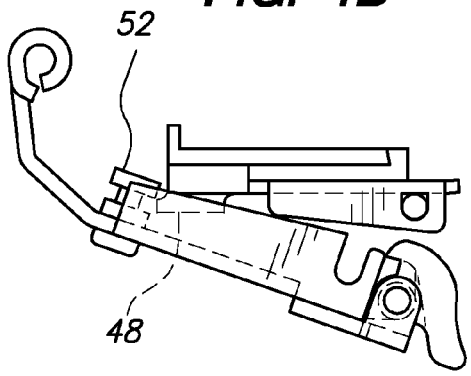
Figure 4C:
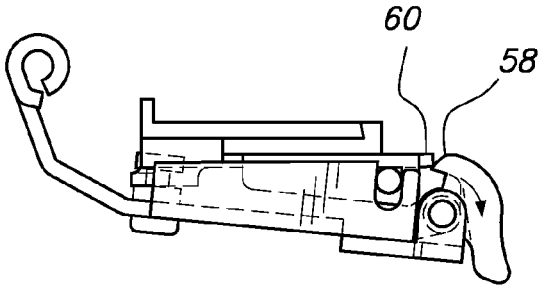

The shoulder 52 is first aligned with the slot in the bridge 48 of the connecting plate as illustrated in FIG. 4B. The shoulder screw is then fully positioned in the bridge slot and the pin 46 is aligned with the upper plate positioning slot 56 as seen in FIG. 4C. As the slot of upper plate is further engaged by the pin, the leading edge 58 of head of the pivot lever is in contact with the catch 60 on the mounting and adjustment assembly. The pivot lever begins to rotate as the upper plate is fastened to the mounting and adjustment assembly. The catch on the mounting and adjustment assembly is typically part of the connecting plate.

Figure 4D:
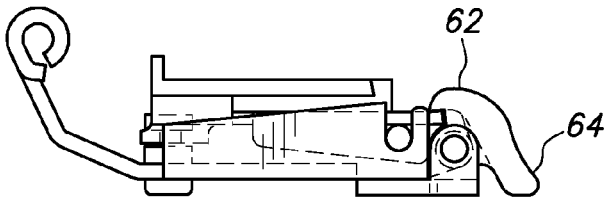

The pivot lever contains an internal spring 25 shown in FIG. 4A which biases the lever into a locked position when the leading edge 58 clears the catch 60. When the upper plate is fully fastened as shown in FIG. 4D, the head of the pivot lever is engaged over the catch in locked position 62. To remove the upper plate, one would merely push gently on the trailing edge 64 of the pivot lever to counter the force of the internal spring and release the upper plate from the locked position.

Figure 5:
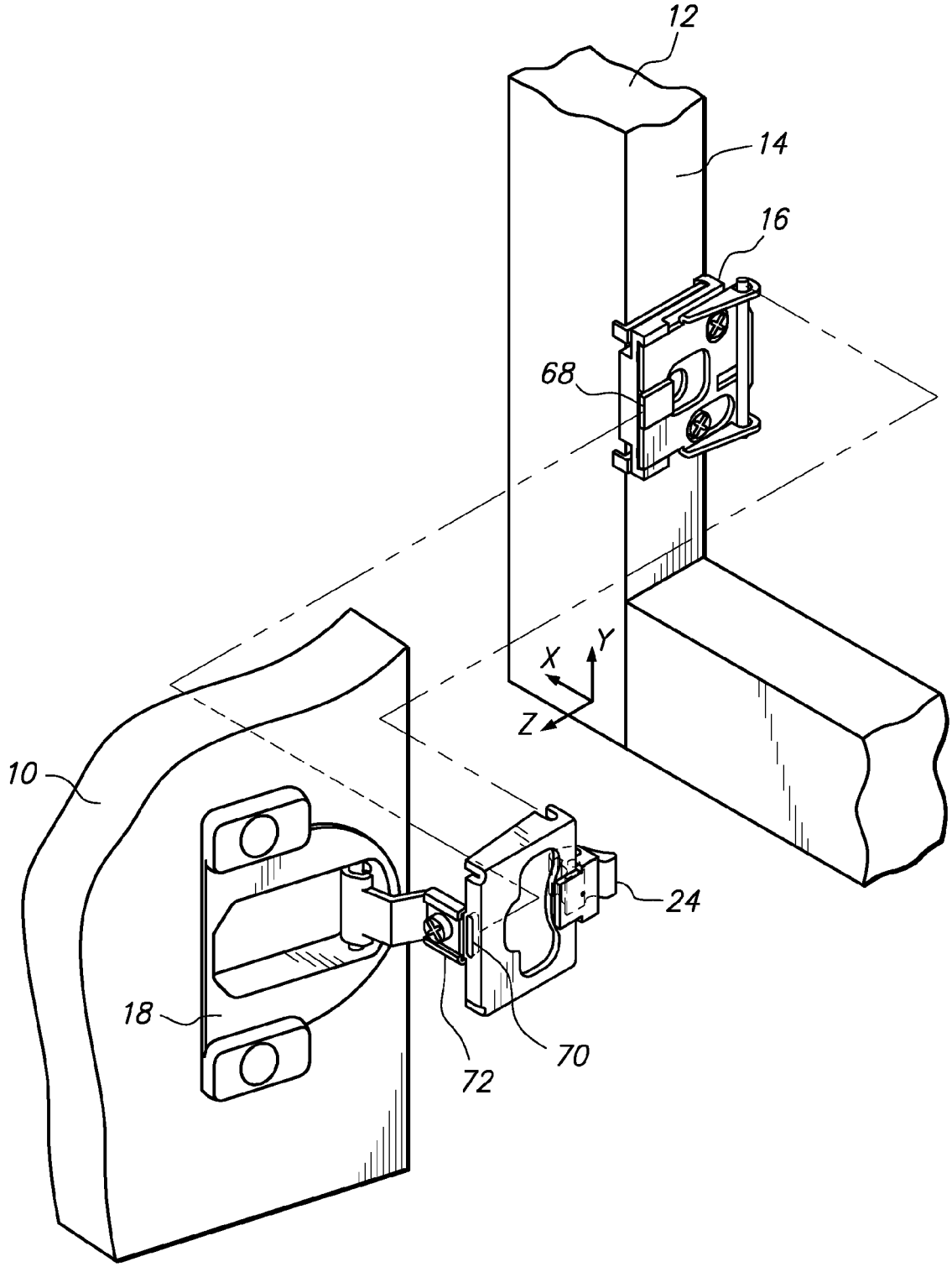
FIG. 5 is a perspective view of another embodiment of a mounting and adjustment assembly and upper plate and arm.

FIG. 5 shows another embodiment of a mounting and adjustment assembly and upper plate and arm. An embodiment of this nature could accommodate a door that provides a bigger overlay. In this embodiment the bridge 68 on the connecting plate does not have a slot because there is no shoulder screw on the upper plate. The end of the bridge 68 actually engages in a bridge positioning slot 70 on the upper plate. The upper plate would be attached to the mounting and adjustment assembly by first aligning and inserting the end of the bridge 68 into the bridge position slot 70 on the upper plate. The upper plate can then be fastened into a locked position in the manner described with the previous embodiment.

Adjustments on the mounting and adjustment assembly in both embodiments illustrated offer movement of the cabinet door in the horizontal (z) and vertical (y) directions. Embodiments of the present invention also allow movement of the cabinet door approximately along the x-axis. This adjustment is useful whether one or two doors are mounted on a face-frame cabinet. The spacing between the adjacent surfaces of the two doors is critical to appearance and function. The x-axis adjustment can be utilized to alleviate uneven spacing between two doors mounted on a cabinet face-frame.

The upper plate 22 shown in the FIG. 1 embodiment has an adjusting shoulder screw 26 that provides for movement of a cabinet door approximately along the x-axis. This movement approximately along the x-axis is relative to the cabinet door being in a closed position.

The adjusting mechanism for movement approximately along the x-axis is positioned on a bracket 72 of the upper plate on the embodiment illustrated in FIG. 5. This adjustment also allows door movement approximately along the x-axis relative to the cabinet door being in a closed position as previously disclosed.

CONCLUSIONS, OTHER EMBODIMENTS, AND SCOPE OF INVENTION

The three main components of the mounting assembly, the connecting plate, the adjustment plate and the base plate can be interconnected through a variety of manners. In one embodiment, the dovetailed sections are swaged so that the plates can have limited movement with respect to an adjacent plate. Other types of metal forming procedures could be utilized to allow each plate limited movement with respect to the adjacent plate.

The connecting plate pin 46 can also be affixed to the connecting plate by a variety of methods. Either cold or hot metal forming procedures could be utilized effectively.

The pivot lever disclosed herein is spring actuated. An internal spring helps engage the lever into a locked position. Other embodiments could include a pivot lever that does not utilize an internal spring. A cam, latch or screw component could be utilized to hold the lever in a locked position until an operator unlocked the lever. A spring-actuated lever is preferable due to the ease in unlocking the lever and removing the door and attached hinge components from the mounting and adjustment assembly.

The position of the pivot lever on the upper plate also aids in removing the door from the mounting assemblies. An installer can support the door with one hand and quickly flip each pivot lever to remove the door from its mountings.

Other embodiments of a face-frame hinge could have only two adjustment mechanisms as an integral part of the hinge. One example of such an embodiment would be to eliminate the adjustment plate and have a first adjustment on the connecting plate and a second adjustment on the upper plate. In these embodiments, the connecting plate would still be utilized to attach and secure the upper plate to the mounting assembly and frame. The connecting plate could be adjusted along only one axis, i.e., either the z or the y axis. The second adjustment on the upper plate would allow the cup to be adjusted approximately along the x axis. All embodiments would include a locking mechanism attached to the upper plate. Although there would only be one adjustment mechanism integral to the mounting assembly, there could still be adjustment of the assembly along the axis not controlled by the first adjustment mechanism. Adjustment along the axis not affected by the first or second adjustment mechanism could be accomplished through the use of standard screw fitted into a slot in the mounting plate, for example.

In yet another embodiment with a locking mechanism attached to the upper plate, only two adjustment mechanisms would be integral to the hinge. As an example, the third adjustment could be eliminated from the upper plate. Thus, there would only be a first and second adjustment integral to the mounting and adjustment assembly.

When an adjustment mechanism "integral to the hinge" is referenced, this does not include a slot that could accommodate a standard screw attached to the frame. An adjustment mechanism in the context of the embodiments of this invention that is integrated with a hinge must be mounted on a hinge component.

Thus, although there have been described particular embodiments of the present invention of a new and useful device, it is not intended that such references be construed as limitations upon the scope of this invention except as set forth in the following claims.

What is claimed is:

1. A hinge for detachably anchoring a door leaf to a frame of an article of furniture so as to enable movement of the door leaf between open and closed positions with respect to the frame, comprising:

a mounting and adjustment assembly to be secured to the frame;

an upper plate to be detachably secured to said mounting and adjustment assembly;

a first adjustment mechanism connected to said mounting and adjustment assembly for adjusting a first portion of said mounting and adjustment assembly horizontally with respect to the frame;

a second adjustment mechanism connected to said mounting and adjustment assembly for adjusting said first portion and a second portion of said mounting and adjustment assembly vertically with respect to the frame;

a locking mechanism connected to said upper plate to detachably secure said upper plate to said mounting and adjustment assembly;

an arm connected to said upper plate;

a cup connected to said arm, said cup to be secured to the door leaf; and a third adjustment mechanism connected to said upper plate to allow movement of said door leaf with respect to said frame in a direction approximately orthogonal to said horizontal and vertical directions.

2. The hinge of claim 1 wherein said mounting and adjustment assembly comprises a mounting plate to be secured to the frame of an article of furniture, said second portion being an adjustment plate adjustably connected to said mounting plate and first portion being a connecting plate adjustably attached to said adjustment plate.

3. The hinge of claim 2 wherein said mounting plate comprises at least one mounting plate surface for alignment of a corresponding surface of said adjustment plate.

4. The hinge of claim 3 wherein said at least one mounting plate surface comprises a beveled surface.

5. The hinge of claim 2 wherein said adjustment plate comprises at least a first adjustment plate surface for alignment with a corresponding surface of said mounting plate, and at least a second adjustment plate surface for alignment with a first connecting plate surface.

6. The hinge of claim 5 wherein said at least first adjustment plate surface and said at least second adjustment plate surface comprises a beveled surface.

7. The hinge of claim 5 wherein said first connecting plate surface comprises a beveled surface.

8. The hinge of claim 2 wherein said connecting plate further comprises a bridge; said bridge further comprising a slot.

9. The hinge of claim 8 wherein said third adjustment mechanism is a screw mounted directly on said upper plate.

10. The hinge of claim 9 wherein said screw further comprises at least one shoulder for engagement with said slot of said connecting plate bridge.

11. The hinge of claim 2 wherein said upper plate comprises a C-shaped bracket to connect said arm and cup to said mounting and adjustment assembly.

12. The hinge of claim 11 wherein said third adjustment mechanism is a screw.

13. The hinge of claim 1 wherein said locking mechanism comprises a lever pivotable into a locking position.

14. The hinge of claim 13 wherein said locking mechanism further comprises a spring.

15. The hinge of claim 14 wherein said lever has a leading edge engagable with said mounting and adjusting assembly.

16. The hinge of claim 1 wherein said locking mechanism comprises a lever that pivots into a locking position.

17. The hinge of claim 16 wherein said locking mechanism further comprises a spring.

18. The hinge of claim 17 wherein said lever has a leading edge engagable with said mounting and adjusting assembly.

19. The method of detachably anchoring the door leaf to the frame of an article of furniture utilizing the hinge of claim 1 comprising:

securing said mounting and adjustment assembly to the frame, securing said cup, arm and upper plate to thea door leaf, and attaching said cup, arm and upper plate to said mounting and adjustment assembly via said locking mechanism.

* * * * *